United States Patent [19]

Fukuoka et al.

[11] Patent Number: 4,482,028

[45] Date of Patent: Nov. 13, 1984

[54] MUFFLER FOR INTERNAL COMBUSTION ENGINE

[75] Inventors: Takashi Fukuoka, Fuchu; Yoshikiyo Kamata, Hachioji, both of Japan

[73] Assignee: Kioritz Corporation, Tokyo, Japan

[21] Appl. No.: 458,808

[22] Filed: Jan. 18, 1983

[30] Foreign Application Priority Data

May 25, 1982 [JP] Japan ..... 57-75757[U]

[51] Int. Cl.[3] ..... F01N 7/10

[52] U.S. Cl. ..... 181/240; 181/238; 181/272; 181/281

[58] Field of Search ..... 181/240, 264, 283, 211, 181/238, 239, 282

[56] References Cited

U.S. PATENT DOCUMENTS 1,059,910 4/1913 Russell et al. ..... 181/264

1,775,511 9/1930 Chapman ..... 181/240

3,921,290 11/1975 Bailey ..... 30/381

4,413,705 11/1983 Inaga et al. ..... 181/240

*Primary Examiner*—Michael L. Gellner

*Assistant Examiner*—Brian W. Brown

*Attorney, Agent, or Firm*—Karl W. Flocks; Sheridan Neimark

[57] ABSTRACT

Disclosed in an exhaust muffler for internal combustion engine such as opposed twin cylinder 2-cycle internal combustion engine of simultaneous ignition type for driving a chain saw. The muffler is connected at a plurality of points thereof to portions of the engine such as cylinders, characterized by comprising a corrugation S for absorbing thermal distortion provided in at least one side wall of the part of the muffler between adjacent portions at which the muffler is connected to the engine.

1 Claim, 2 Drawing Figures

MUFFLER FOR INTERNAL COMBUSTION ENGINE

BACKGROUND OF THE INVENTION

The present invention relates to a muffler for internal combustion engine.

Generally speaking, the muffler attached to internal combustion engine is heated to a considerably high temperature during the operation of the engine. For instance, in the case of small-sized air-cooled 2-cycle internal combustion engines, the temperature of exhaust gas flowing through the muffler well reaches 600° to 700° C. so that the muffler itself is heated to develop a high temperature of 300° to 400° C. at the surface thereof to exhibit a considerable thermal distortion. Such a thermal distortion does not cause substantial problem when the body of the muffler is fixed to the body of the internal combustion engine only at one portion thereof because, in such a case, the thermal distortion is effectively absorbed at the free end of the muffler body but various problems are caused when the muffler body is fixed at a plurality of portions thereof. The problem is serious particularly in opposed twin type engine in which only one muffler is connected commonly to two cylinders which are arranged horizontally opposite one another. Namely, in such a case, the muffler is connected to the exhaust ports of two cylinders spaced from each other so that the thermal distortion of the muffler during operation of the engine cannot be absorbed and a force is applied to the muffler to forcibly stretch the muffler at the portion thereof between the two points where the muffler is connected to the exhaust ports of the cylinders. In consequence, relative positions of various parts are changed undesirably. Such changes in the relative positions, although they may be slight, causes various troubles such as local wear of cylinders and pistons, seizure, abnormal vibration, leak of compressed gas and so forth.

SUMMARY OF THE INVENTION

Under these circumstances, the present invention aims as its primary object at providing a muffler for internal combustion engine, in which a corrugation is provided at least at one side thereof to absorb the thermal stress to avoid any concentration of deforming force to the fixed poritons of the muffler, thereby to overcome the above-described problems of the prior art.

To this end, according to the invention, there is provided an exhaust muffler for internal combustion engine, connected at a plurality of points thereof to portions of the engine such as cylinders characterized by comprising a corrugation S for absorbing thermal distortion provided in at least one side wall of the part of the muffler between adjacent portions at which the muffler is connected to the engine.

Other objects, feastures and advantages of the invention will become clear from the following description of the preferred embodiments taken in conjunction with the accompanying drawings.

DESCRIPTION OF THE PREFERRED EMBODIMENT

A preferred embodiment of the invention will be described hereinunder with reference to the accompanying drawings.

Figure 1:
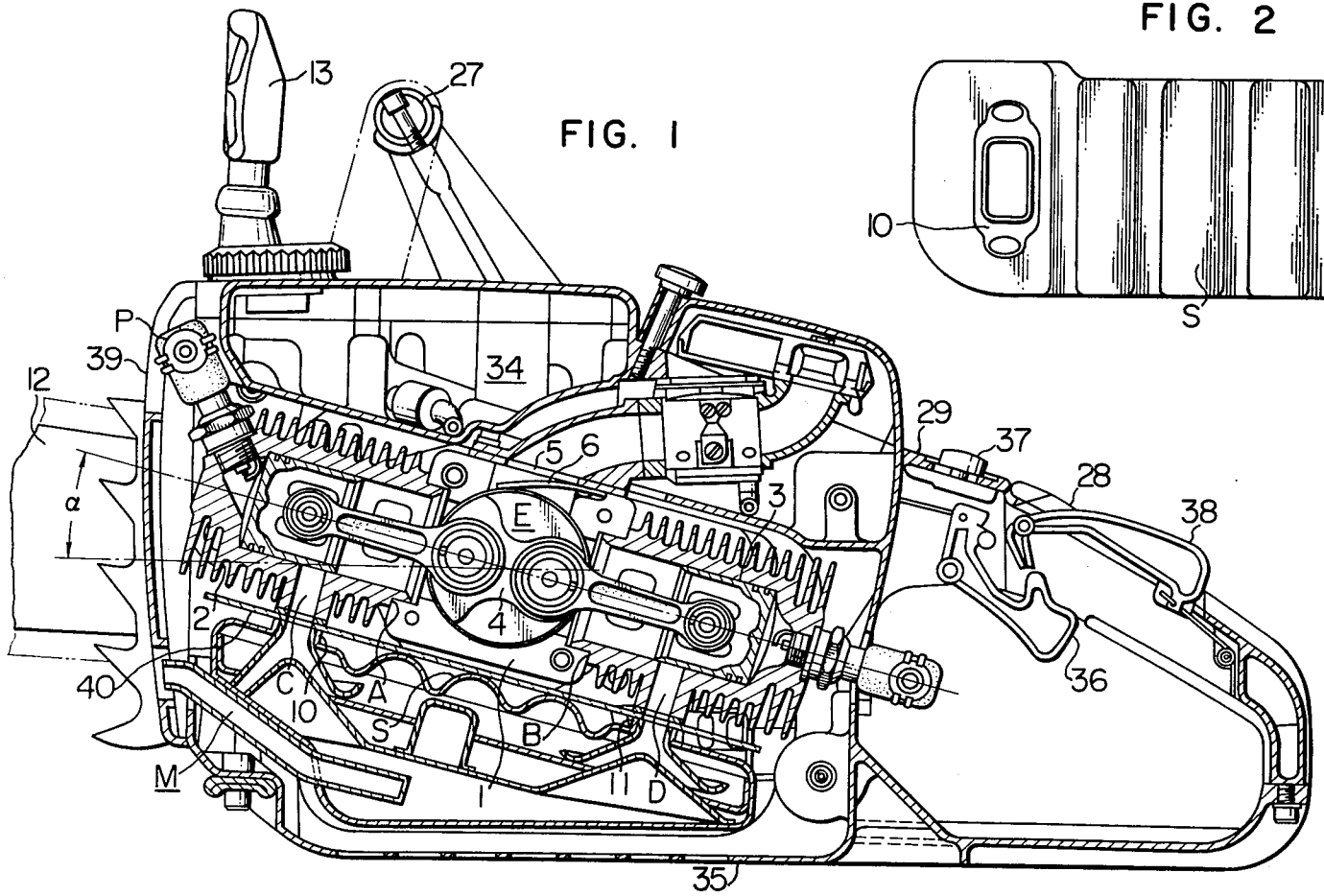
FIG. 1 is a side elevational view of a chain saw having an opposed twin 2-cycle internal combustion engine of simultaneous ignition type, with an essential part shown in section.

As shown in FIG. 1, a chain saw has an internal combustion engine unit which includes a 2-cycle opposed twin cylinder internal combustion engine of simultaneous ignition type, having a total displacement substantially equal to that of an imaginary single cylinder engine which produces the same power required for driving the saw chain. The 2-cycle opposed twin cylinder internal combustion engine of simultaneous ignition type is a 2-cycle internal combustion engine having two cylinders disposed substantially horizontally with 180° angular difference therebetween, i.e. such that the cylinders have a common axis which extends substantially horizontally, wherein the ignition takes place simultaneously in both cylinders. Thus, in this engine unit, the pistons and other movable parts associated with both cylinders act in synchronization but in the opposite directions to negate the inertia of masses of the moving parts to perfectly obviate the cause of the vibration.

The common axis of the two opposing cylinders is not laid perfectly horizontally but is slightly inclined upwardly and forwardly at an angle $\alpha$ to reduce the overall length of the chain saw. A further reduction of the overall length is achieved by upwardly inclining the ignition plug P of the front side cylinder to the common axis of the cylinders.

The inclination of the cylinders creates an upper rear and lower front spaces between the engine unit and the frame. The upper rear space constitutes an intake system chamber accommodating an intake system of the engine unit including a carburetor, while the lower front space is used as a space for mounting an exhaust muffler of a sufficiently large capacity and having an exhaust outlet directed forwardly, i.e. away from the operator to protect the operator from the exhaust noise and noxious gases emitted from the engine.

A crank case 1 is provided in its upper side wall with a suction port 5 which is adapted to be opened and closed by a reed valve 6. As the pressure in the crank case 1 is lowered to a level below the atmospheric pressure, the reed valve 6 is deflected to open the suction port 5 so that the space in the crank case 1 is communicated with the intake system chamber to such the air-fuel mixture. Thus, the engine E is of the crank case intake and scavenging type 2-cycle internal combustion engine. The crank case 1 is of the so-called split type one divided at an intermediate portion of the crank shaft in the direction perpendicular to the direction of the crank shaft.

Figure 2:
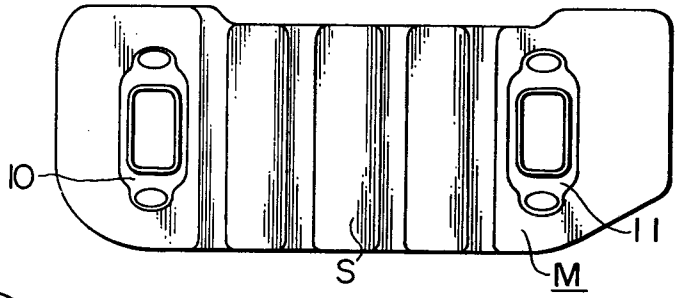
FIG. 2 is a plan view of a muffler in accordance with the present invention.

According to the invention, the body of a single muffler M is connected commonly to both cylinders 2 and 3 which are secured to both sides of the crank case 1 at the junctures A and B, respectively. More specifically, the body of the muffler M is fixed at its portions 10 and 11 to the exhaust ports C and D of the cylinders 2 and 3 with a heat insulating plate 40 placed between the muffler M and the cylinders 2 and 3. According to the invention, one side wall of the portion of the muffler M between two fixing portions 10 and 11 is constituted by a corrugation S for absorbing thermal distortion, consisting of continuous crests and valleys of a substantially semi-circular cross-section. As will be clearly seen from FIG. 2, each crest and each valley of the corrugation S has a length which fully occupies breadth of the side wall of the muffler M.

The frame 29 of the chain saw has front and rear handles 27 and 28. The rear handle 28 has a grip around which mounted are a throttle lever 36, a start and stop switch 37 and a throttle safety device 38. The opened front end of the frame 29 is covered by a front cover 39. The aforementioned heat insulating plate 40 serves to insulate the cylinders 2 and 3 from the heat radiated from the muffler M, while defining the passage for the cooling air.

In the muffler M of the invention having the described construction, the thermal distortion of the muffler M is effectively absorbed by the corrugation S even though the muffler M is heated up to a high temperature during the operation of the engine E so that the concentration of the force to the portions 10 and 11 at which the muffler M is fixed is avoided to ensure a smooth operation of the engine E.

In addition, it is possible to increase the silencing effect by suitably selecting the position and shape of the corrugation S.

Although the invention has been described through specific terms, it is to be noted here that the described embodiment is not exclusive but merely illustrative.

For instance, the corrugation S may be provided also in the other side wall of the portion of the muffler M between two fixing portions 10 and 11, although only one side wall is corrugated in the described embodiment. By so doing, it is possible to achieve higher effect of absorption of thermal distortion.

Other changes and modifications are possible within the scope of the invention which is limited solely by the appended claim.

What is claimed is:

1. An exhaust muffler for internal combustion engine, connected at a plurality of points 10, 11 thereof to portions of said engine characterized by comprising a corrugation S for absorbing thermal expansion and contraction of said muffler provided in at least the part of said muffler between said points 10, 11 at which said muffler is connected to said engine.

* * * * *